United States Patent [19]

Sidner

[11] 4,031,798

[45] June 28, 1977

[54] SOUNDBOARD FOR STRINGED MUSICAL INSTRUMENTS

[76] Inventor: Arthur E. Sider, 158 North Hazel, St. Paul, Minn. 55133

[22] Filed: Oct. 31, 1975

[21] Appl. No.: 627,390

[52] U.S. Cl. ..... 84/291; 84/194; 84/268; 84/307

[51] Int. Cl.[2] ..... G10D 3/02

[58] Field of Search ..... 84/192, 193, 194, 195, 84/298, 268, 269, 276, 275, 291, 307, 308, 294

[56] References Cited

UNITED STATES PATENTS

| | | | |
|---|---|---|---|
| 191,029 | 5/1877 | Collins | 84/192 |
| 320,264 | 6/1885 | Lomas | 84/192 |
| 1,149,059 | 8/1915 | Ingram | 84/291 |

*Primary Examiner*—Lawrence R. Franklin
*Attorney, Agent, or Firm*—Warren R. Bovee

[57] ABSTRACT

Soundboards for stringed musical instruments comprising radially/circumferentially anisotropic sheets. The soundboards may be constructed of wooden wedges arranged so that the wood grain radiates from the focal point of the sheet. The soundboards preferably have at least a partially rounded periphery. Stringed instruments containing the novel soundboards are disclosed wherein the strings are coupled to the soundboards through a bridge located near the focal point of the soundboard.

9 Claims, 4 Drawing Figures

SOUNDBOARD FOR STRINGED MUSICAL INSTRUMENTS

This invention relates to soundboards for acoustic, stringed musical instruments which improve the sound character of the instruments. More specifically, the disclosed soundboards provide stringed instruments having an improved balance between maximum volume and minimum sound coloration or distortion.

The characteristic vibration of tuned strings has long been used to produce pleasing musical sounds. In order to increase the sound of the vibrating strings so that the sounds will be sufficiently audible to the human ear, the strings have been connected, through a bridge, to a soundboard, whereby a more efficient acoustical coupling between the vibrating strings and the air is obtained.

As performers have used stringed instruments to perform for larger audiences, the need to achieve maximum volume from the vibrating strings has become of paramount importance, particularly for the hand-held stringed instruments which have smaller soundboards, such as the lute and its relatives, e.g., vihuela, guitar, and the like. However, in modifying the instruments to achieve greater sound volume the characteristic pure sound of the vibrating string, i.e. the regular, ordered, relationship between the fundamental vibrating mode of the string and the higher overtones, was often lost or overshadowed by the "color" contributed by the freely vibrating modes of the soundboard itself.

The coloration effect imparted by the soundboard can be more clearly understood by considering how the soundboard operates to amplify the sounds of the vibrating strings. Generally one end of the strings of the musical instrument is fastened to tuning pegs. The other end of each string is connected to a bridge which is firmly attached to a soundboard. The soundboard comprises a thin plate of wood which is flexible and resilient enough to vibrate in response to the vibrations which are induced in the strings such as by striking or plucking the strings.

Ideally, the soundboard should be capable of vibrational excursions or displacements of relatively large magnitude with little resistance in order to generate the greatest sound volume and faithfully reproduce the vibration modes of the strings which drive the soundboard. In order to produce such an ideal soundboard, the board must be very thin and somewhat flexible to allow the necessary movement. However, such a thin member, particularly a thin piece of wood, has a tendency to "break up" into "Tree" vibrational modes which generate tones not related to the vibrating modes present in the string.

Tones generated by the free vibrational patterns occurring in the soundboard color the sound produced by the instrument by adding tones which are not present in the vibrating string and may further color the sound by feeding back random vibrations to the strings. Although this color may not be objectionable (sometimes even desirable) for some musical forms such as folk and rock music, such color is not generally considered desirable for classical music where pure, "transparent" tones are desired.

Early plucked-string instruments used for classical music, such as the lute, vihuela, clavichord, harpsichord, etc., employed wooden soundboards having the grain running parallel to the strings and were braced with one or more wooden braces running across the grain to stiffen the soundboard. This arrangement resulted in a pure, clean tone, but very low volume. In order to increase the volume of these early instruments, more strings were added which had the adverse effect of making these instruments more complex and difficult to construct and difficult to play and keep in tune. These technical difficulties were largely responsible for the decrease in popularity of these instruments among the general public.

Attempts to improve wooden soundboards have generally been directed towards increasing the volume and obtaining a uniform frequency response. See, for example, U.S. Pat. No. 3,443,465 issued May 13, 1969, and U.S. Pat. No. 3,656,395 issued Apr. 18, 1972. These attempts have involved adding braces in various patterns, the braces having various dimensions and running in a direction substantially parallel to the direction of the grain of the soundboard. While these braces may serve to better couple the bridge motion to the soundboard, the known bracing patterns do not prevent the soundboard from breaking up into free vibration modes across the grain which tend to add color to the sound produced by the instrument.

The present invention overcomes the deficiencies of the previously known stringed instruments by providing unique soundboards for stringed instruments which provide a clean, pure, classical sound with improved volume and sustain without the necessity of adding additional strings. Thus, the soundboards of the present invention can provide instruments having the classical, pure sound of the lute, but with the ease of playing of the guitar.

The unique soundboards of the present invention comprise a solid, flat or arched sheet which is radially/-circumferentially anisotropic. As used herein, the term "radially/circumferentially anisotropic" sheets refers to sheets which have sound transmitting properties which are different when measured in a radial direction compared to the sound transmitting properties measured circumferentially with respect to the center or focal point of the sheet. The radially/circumferentially anisotropic soundboards of this invention are thus distinguished from conventional wooden soundboards which have a longitudinal grain and are therefore longitudinally/transversely anisotropic and are also distinguished from metal resonators and the like which are isotropic.

The radially/circumferentially anisotropic soundboards of the present invention comprise a plurality of stiff, for example, crystalline, fibers or rod-like spokes emanating radially from a "focal point", that is the point where the individual fibers intersect or converge, and contained in a soft, for example, amorphous, sheet-like matrix. Preferably at least a portion of the soundboard is substantially circular or elliptical about the focal point of the soundboard. Thus, the soundboard can be in the form of a semi-circle or semi-ellipse or in the form of a full circle or ellipse, although other substantially regular peripheral shapes can be employed as dictated by the design of the instrument top in which the soundboards are incorporated. As can be appreciated, the soundboards are not necessarily co-extensive with the top of the instrument and in fact in most conventional instruments the soundboard would be only a portion of the top, as shown hereinafter. The regular geometrical shapes such as the substantially circular and elliptical shapes are preferred since it is believed these regular shapes are important to control the vibrating modes of the soundboard, as will be described in greater detail hereinafter, and that these rounded periphery uniformly reflect sound waves emanating from the focal point of the soundboard to said standing waves and thereby improve the sound sustaining properties of the soundboard.

Although the soundboards of the present invention can be various shapes as previously described, for convenience herein the soundboards may be referred to as being circular or semi-circular. However, reference to circular and semi-circular soundboards herein is made for illustrative convenience only and is not intended to limit the invention.

In one embodiment of the invention, the radially/circumferentially anisotropic soundboard comprises a semi-circular or semi-elliptical sheet, preferably a flat sheet, comprising a plurality of longitudinally grained, wedge-shaped wooden sections radiating from the focal point of the soundboard. A bridge comprising a conventional saddle and block and including a base plate having a periphery similar to that of the soundboard is attached to the soundboard at or near the focal point of the soundboard.

The number of wooden wedges used in constructing the soundboard can vary, although it is preferred to have as many wedges as possible so that each of the longitudinal wood fibers in the wedges radiates as nearly as possible from the focal point of the sheet. Preferably the soundboard comprises about one wooden section every 10° of the rounded periphery. Thus, a semi-circular soundbound can be made using about 18 sections.

The woods used for the soundboard can be any of the woods conveniently used for soundboards, particularly the soft woods such as spruce, pine and cedar. Various types of wood can be mixed to achieve special effects. In addition, the soundboards of the present invention can more efficiently utilize the diminishing quantities of high quality spruce since smaller pieces not heretofore useful in the manufacture of conventional two-piece soundboards can be utilized in the present invention.

The wooden sections can be glued together by means known in the art. Various animal and synthetic glues and adhesives can be used. Because the soundboards of the invention contain more glue or adhesive than conventional two-piece soundboards, the qualities of the glue or adhesive can be chosen so as to significantly modify or enhance the sound qualities of the soundboard.

Due to the convergence of the longitudinal stiff fibers in the wood at the focal point of the soundboard, the soundboard tends to be stiff at the center or focal point of the soundboard and more flexible at the periphery. In order to prevent the soundboard from breaking up improperly, ribs or braces, preferably made of wood, can be added to the soundboard. It has been found that the soundboards of this invention should be braced circumferentially, that is, the braces should be perpendicular to the radially running fibers in the soundboard and form one or more concentric rings or semi-rings about the focal point of the soundboard.

The exact location of the braces will vary depending on the size and the materials used in constructing the soundboard. Generally the concentric distance between the braces is inversely proportional to the distance from the focal point. That is, the braces nearer the periphery are closer together than those nearer the focal point, as will be illustrated hereinafter.

It is believed that the use of the concentric braces enhances the ability of the soundboard to vibrate in an advantageous manner. At least two important vibration modes occur in a vibrating soundboard. One results from vibration patterns induced by the vibrating strings, through the bridge, which emanate outward from the focal point of the soundboard. These patterns have circumferential, concentric nodes similar to the waves generated by a pebble dropped in a pool of water. This mode is referred to as the concentric mode of vibration since the nodes are concentric.

A second type of vibration pattern having radial nodes may be generated within the soundboard. These types of vibration patterns are referred to as radial modes of vibration and are not correlated to the frequencies generated by the vibrating strings which "drive" the soundboard. Rather, these radial modes are generated freely within the soundboard and add unwanted coloration to the sound.

The use of the concentric braces in the soundboards of this invention tend to stiffen the soundboards in the circumferential direction, minimizing the tendency of the soundboards to "break up" circumferentially and aiding the natural cross-grain damping properties of the wood in minimizing the radial, free modes of vibration.

Wood is the most preferable material to be used in the soundboards of this invention due to its unique structure and properties. Wood is composed of longitudinal, stiff, somewhat crystalline fibers or fiber tubes separated by a soft, amorphous intercellular substance. As a result of this construction, the wood has a tendency to readily transmit sound vibrations longitudinally, i.e. along the grain, while tending to dampen any vibrations attempting to propagate transverse of the grain. Certain types of soft woods such as spruce and the like have particularly high longitudinal versus transverse transmitting ratios and are advantageously used in the soundboards of this invention. Exemplary of other woods which are suitable are pine, such as Spanish pine, and cedar.

Although wood is the most preferable natural material for the soundboards of this invention due to its unique ability to transmit sound vibrations preferentially along the grain and dampen vibrations across the grain, other sheet materials comprising stiff radial fibers or rods in a soft matrix can be used. For example, the sheet materials can comprise glass, ceramic, polymeric, preferably crystalline polymeric, or metal fibers radially arranged in a resinous, sheet-like matrix. Alternatively, the matrix could comprise a pressed ground wood material with an adhesive binder.

These fiber reinforced sheet materials are known in the art as exemplified by U.S. Pat. Nos. 2,931,739, 2,943,968 and 2,974,062 and the like. Thus soundboards according to the present invention could be made by radially arranging glass fibers and binding them in a synthetic resin matrix. Another embodiment comprises providing a resinous sheet containing longitudinal fibers and cutting wedges therefrom wherein the fibers run longitudinally in the wedges similar to the grain of the aforementioned wooden wedges. These sheet-like wedges can then be assembled to form soundboards much like the wooden wedges as described above.

The soundboards of this invention can be used with advantage in the construction of various stringed musical instruments. Preferably the soundboard is used in stringed instruments wherein the strings are plucked or struck as opposed to those which are bowed. The mechanics of sound generation of each of these types of instruments is very different and the soundboards of the present invention are particularly adapted to efficiently utilize the transient energy peaks associated with the plucked string instruments as opposed to the bowed instruments wherein the energy input is relatively continuous.

It is specifically contemplated that the soundboards of this invention can be used to advantage in the plucked-string instruments such as the lute and the relatives of the lute such as the vihuela, guitar, mandolin and the like, as well as the keyboard-type stringed instruments such as the clavichord, harpsichord and the like.

The present invention can be more clearly illustrated by reference to the drawing wherein FIG. 1 is a perspective view of a lute including a semi-circular, radially/circumferentially anisotropic wooden soundboard according to the present invention.

Figure 1:
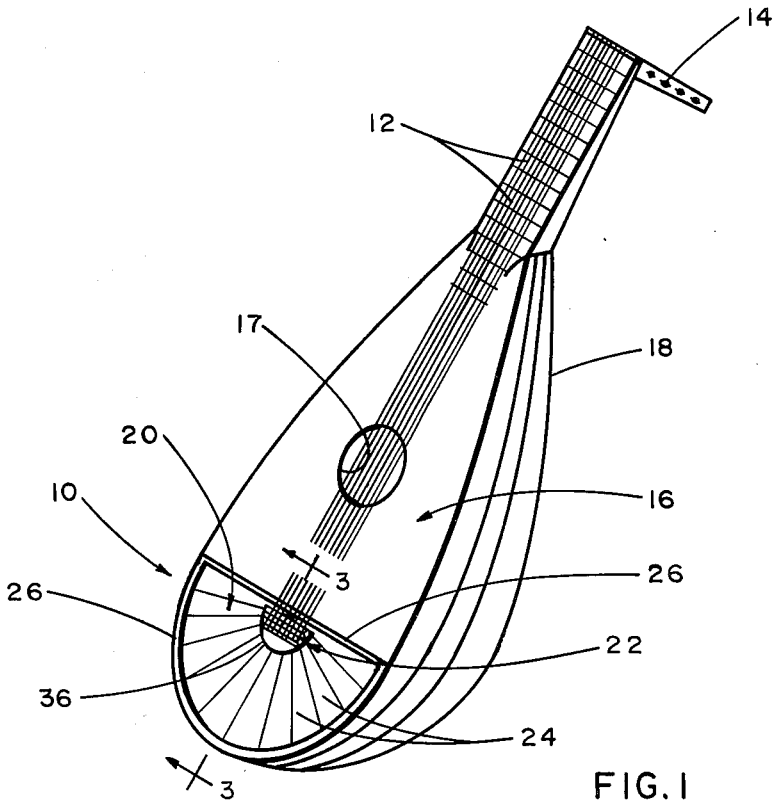

Referring particularly to FIG. 1, there is shown a lute 10 having tensioned strings 12, tuning pegs 14, top 16, and bowl 18. Top 16 contains sound hole 17 and radially/circumferentially anisotropic soundboard 20. Tensioned strings 12 are connected to soundboard 20 by bridge 22, bridge 22 having a semi-circular base 36. Soundboard 20 comprises a plurality of longitudianlly grained wooden wedges 24 arranged so that the soundboard is substantially radially grained. The soundboard 20 is shown as being substantially semi-circular, conforming to the shape of bowl 18 of lute 10. As noted previously, the shape of the soundboard can be varied to accommodate the design of various instruments, although a regular, rounded periphery is preferred.

Soundboard 20 is shown held in top 16 by a peripheral clamping ring 26 and can be readily removed and replaced if desired. Alternatively, soundboard 20 can be adhered to and made a permanently integral part of top 16.

Figure 2:
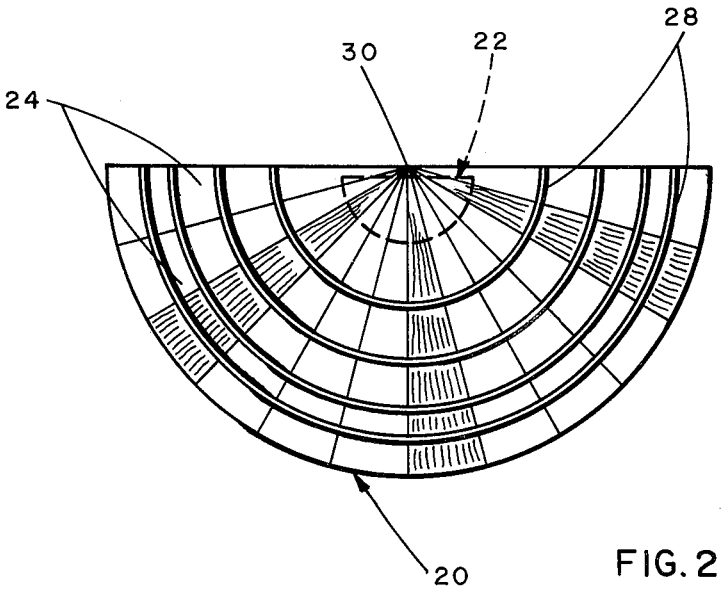
FIG. 2 is a plan view of the underside of the semi-circular soundboard of the lute shown in FIG. 1.

FIG. 2 shows the underside of soundboard 20 comprising longitudinally grained wooden wedges 24 arranged radially about focal point 30. Bridge 22 is shown, in phantom, attached to the top of soundboard 20. Concentric wooden braces 28 are shown attached to soundboard 20 to effectively stiffen the soundboard across the grain of the wooden wedges 24.

This bracing pattern tends to circumferentially stiffen the soundboard 20 minimizing the tendency of the soundboard to break up into undesirable free modes of vibration.

Figure 3:
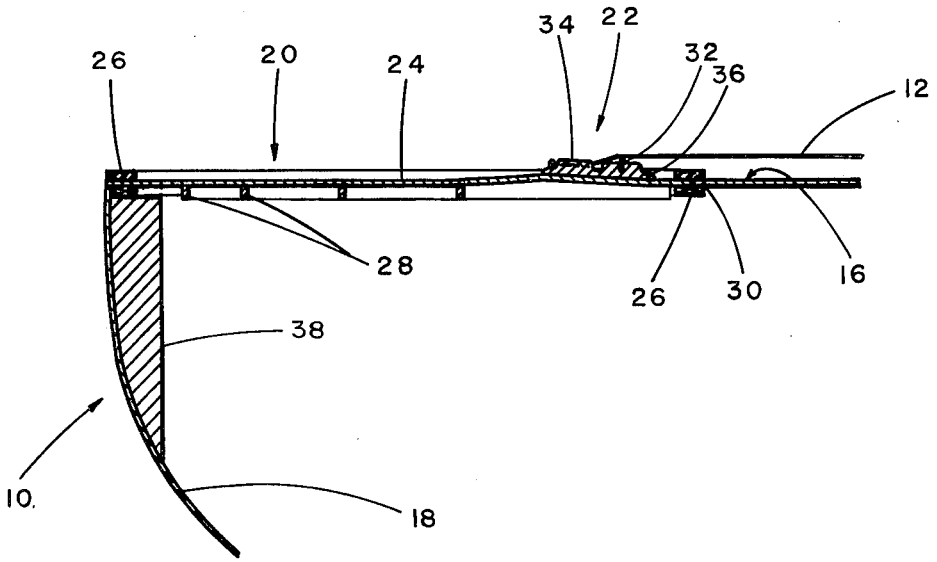
FIG. 3 is a cross-sectional view along line 3—3 of the lute 10 shown in FIG. 1 showing elements of the soundboard and bridge in greater detail.

FIG. 3 is a cross-section along line 3—3 of a portion of lute 10 described in connection with FIG. 1. FIG. 3 shows soundboard 20 with bridge 22 attached near the focal point 30 of soundboard 20, and braces 28 on the underside of the soundboard. Bridge 22 comprises saddle 32, tie block 34, and base 36 which is attached directly to soundboard 20, generally by adhesives, glue or other fastening means. Clamping ring 26 is shown as a pair of metal rings surrounding and retaining soundboard 20 in fixed relation to top 16 of lute 10. Tailblock 38 is shown where the sides of the bowl of lute 10 are joined.

Figure 4:
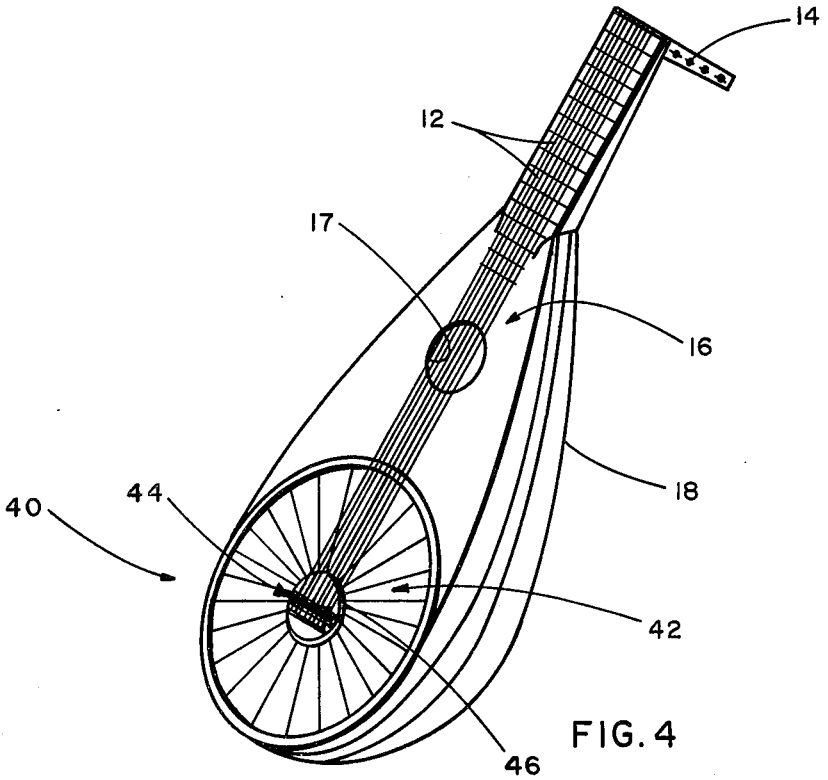
FIG. 4 is a perspective view of a lute including a circular, radially/circumferentially anistropic wooden soundboard according to the present invention.

FIG. 4 shows a lute 40 similar to lute 10 shown to FIG. 1, except that lute 40 contains a circular, radially/circumferentially anisotropic wooden soundboard 42 in contrast to the semi-circular soundboard 20 shown in lute 10 of FIG. 1. Bridge 44, having circular base 46, is shown attached near the focal point of soundboard 42. Circular soundboards, such as those shown in FIG. 4, provide greater volume and more natural reproduction of the base frequencies than the smaller, semi-circular soundboards, but may have a greater degree of overall tone coloration.

I claim:

1. A soundboard for stringed musical instruments comprising a solid sheet which is radially/circumferentially anisotropic and which comprises a plurality of longitudinally-grained, wooden sections radiating from the focal point of the sheet and wherein said sheet includes a plurality of curved braces concentric about the focal point of said sheet.

2. A soundboard according to claim 1 wherein the periphery of said soundboard is at least partially rounded.

3. A plucked-string musical instrument comprising tensioned strings, a soundboard, and means coupling said strings to said soundboard wherein the improvement comprises a soundboard which is a radially/circumferentially anisotropic sheet comprising stiff fibers in a matrix, said fibers running substantially radially from a focal point of said sheet, said soundboard including a plurality of braces concentric about said focal point and wherein means coupling said strings to said soundboard is a bridge attached near said focal point.

4. A plucked-string musical instrument according to claim 3 wherein the periphery of said soundboard is at least partially rounded and the base of said bridge has a periphery similar to the periphery of said soundboard.

5. A plucked-string musical instrument according to claim 4 wherein said soundboard comprises a substantially semi-circular sheet comprising a plurality of longitudinally grained wooden sections radiating from a focal point on the straight edge of said sheet and wherein said soundboard includes curved braces on the underside of said sheet which are concentric about the focal point of the sheet.

6. A plucked-string musical instrument according to claim 5 wherein said bridge has a semi-circular base having its straight edge adjacent and parallel to the straight edge of the soundboard.

7. A plucked-string musical instrument according to claim 4 wherein said soundboard comprises a substantially circular sheet comprising a plurality of longitudinally grained wooden sections radiating from a focal point in the center of said sheet and wherein said soundboard includes curved braces on the underside of said sheet which are concentric about the focal point of the sheet.

8. A plucked-string instrument according to claim 3 wherein said instrument is a lute.

9. A plucked-string instrument according to claim 3 wherein said instrument is a guitar.

* * * * *

UNITED STATES PATENT AND TRADEMARK OFFICE

CERTIFICATE OF CORRECTION

PATENT NO. : 4,031,798

DATED : June 28, 1977

INVENTOR(S) : Arthur E. Sidner

It is certified that error appears in the above-identified patent and that said Letters Patent are hereby corrected as shown below:

On the cover page:

Column 1, line 3, after "Inventor", correct the spelling of the inventor's name to -- Arthur E. Sidner -- ;

line 4, after "Minn." correct the Zip Code to read -- 55119 -- .

Column 1, line 52, change '"Tree"' to -- "free" -- .

Column 5, line 38, correct the spelling of -- longitudinally -- at the end of the line.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*